US006824736B1

(12) United States Patent
Wan

(10) Patent No.: US 6,824,736 B1
(45) Date of Patent: Nov. 30, 2004

(54) PUSHER FURNACE RAILS WITH PLATE-SHAPED SLIDING SUPPORTS AND SLIDING SHOES

(75) Inventor: Gang Wan, Hagen (DE)

(73) Assignee: Otto Junker GmbH (DE)

( * ) Notice: Subject to any disclaimer, the term of this patent is extended or adjusted under 35 U.S.C. 154(b) by 0 days.

(21) Appl. No.: 10/110,555

(22) PCT Filed: Sep. 29, 2000

(86) PCT No.: PCT/DE00/03453

§ 371 (c)(1),
(2), (4) Date: Sep. 12, 2002

(87) PCT Pub. No.: WO01/27548

PCT Pub. Date: Apr. 19, 2001

(30) Foreign Application Priority Data

Oct. 13, 1999 (DE) ..... 199 49 406

(51) Int. Cl.[7] ..... C21D 1/06
(52) U.S. Cl. ..... 266/252; 266/274; 432/239
(58) Field of Search ..... 266/274, 252; 432/152, 239, 234

(56) References Cited

U.S. PATENT DOCUMENTS 1,851,913 A 3/1932 Lange
4,412,816 A 11/1983 Schlumberger et al.
4,540,364 A 9/1985 Ebner
5,301,929 A 4/1994 Pflanz et al.

FOREIGN PATENT DOCUMENTS

| | | | | |
|---|---|---|---|---|
| DE | 925950 | | 4/1955 | |
| DE | 2039507 | | 2/1972 | |
| EP | 0479516 | | 9/1991 | |
| GB | 2240820 A | * | 8/1991 | ..... 266/274 |

* cited by examiner

*Primary Examiner*—Scott Kastler
(74) *Attorney, Agent, or Firm*—John C. Purdue; David C. Purdue

(57) ABSTRACT

The invention relates to a pusher furnace (1) for the annealing treatment of aluminum bars for instance. Rails (7) with plate-shaped sliding supports (8) are provided. Said supports cover the entire width of the rails (7) and are produced with grooves (12) on the upper sides thereof. The grooves extend in the longitudinal direction of the rails (7) in an arrow-shaped manner and serve for receiving driven material. Several sliding supports (8) are juxtaposed and thereby form arrow-shaped expansion joints. The rails (7) and the sliding supports (8) can be easier produced and assembled by virtue of the inventive embodiment of said rails (7) and sliding supports (8). Furthermore, the material (10) can be transported without jolts in as far as possible, whereby said material is mounted on sliding shoes (9).

20 Claims, 2 Drawing Sheets

PUSHER FURNACE RAILS WITH PLATE-SHAPED SLIDING SUPPORTS AND SLIDING SHOES

Figure 1:
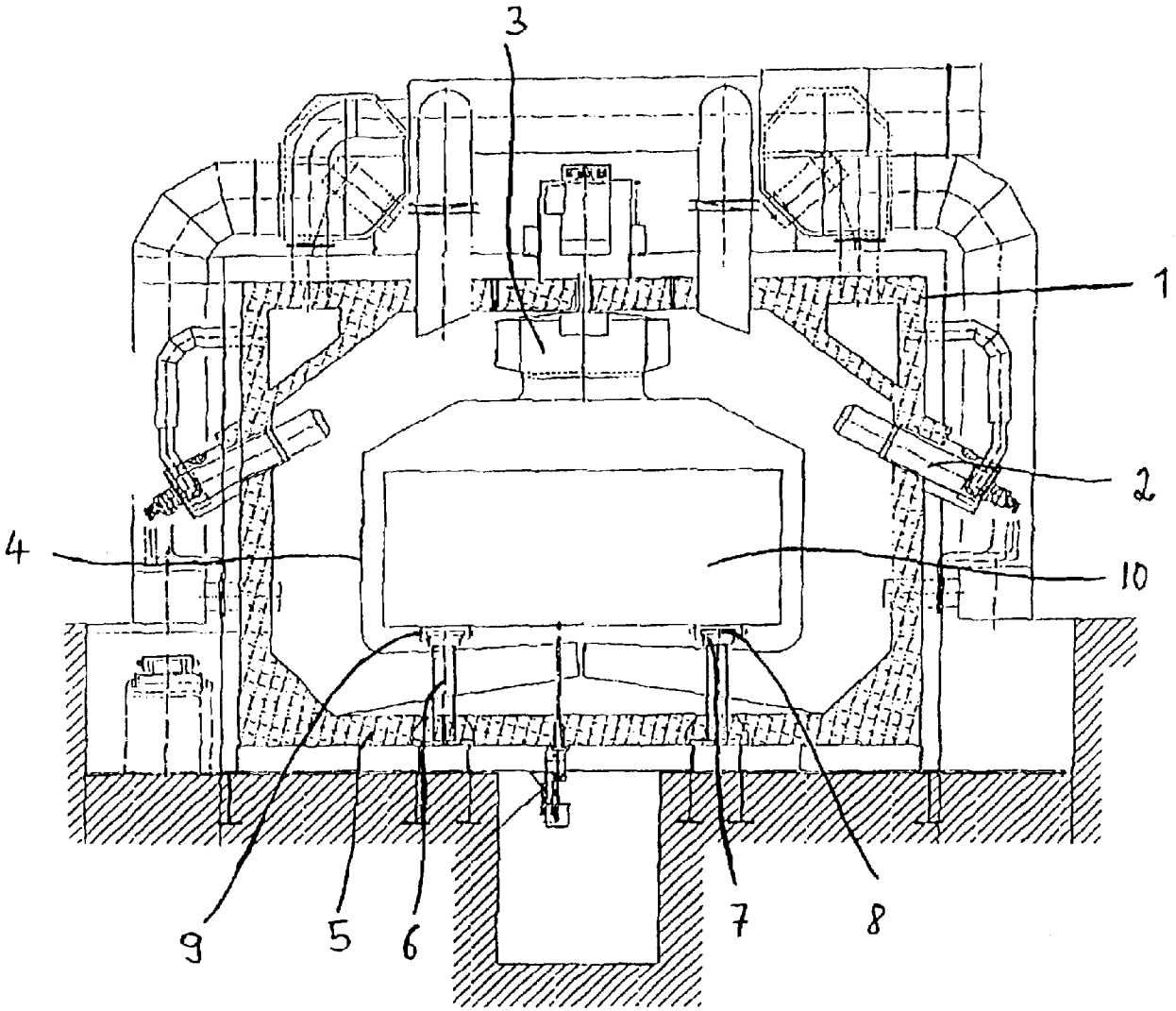

The invention relates to a pusher furnace with rails and with sliding shoes which are guided displaceably on these and carry the treatment material to be transported through the furnace, sliding supports which have grooves for receiving material abrasion being provided on the rails.

Pusher furnaces are used mostly for the annealing treatment of bars, for example aluminium bars. Bars of this type may weigh several tons and are therefore usually moved with the aid of hydraulic pusher devices.

EP 0 108 047 B1 discloses a pusher furnace, the rails of which are provided with a multiplicity of sliding elements. These sliding elements are inserted, each sliding element separately, into shallow recesses, lying one behind the other and next to one another, on the surface of the rails and project out of the surface of the rails. These sliding elements may have surface grooves, running obliquely to the rail longitudinal direction, for receiving material abrasion. The plate-shaped sliding elements form, with their short sides which are produced perpendicularly to the rail longitudinal direction, smooth butt edges to the sliding shoes displaceable on the sliding elements. Butt edges which are so smooth are disadvantageous, since, when the sliding shoes strike these edges, jolt-like movements may occur and consequently critical loads on the sliding shoes and sliding elements. If the sliding elements are mounted above the joint region of two rails, there is the risk of fracture. A further disadvantage of the above version is that rails and sliding elements have to be produced separately and a multiplicity of sliding elements per rail have to be fastened in a complicated way, for example by means of screws.

The object of the present invention, then, is to provide a pusher furnace of the type mentioned in the introduction, which, along with a simple construction, allows a jolt-free displacement of sliding shoes subjected to high load.

According to the invention, therefore, it is proposed to produce the pusher furnace in such a way that the sliding supports are of plate-shaped design, these in each case fully cover the rails over their width and are provided on their top sides with grooves, running in an arrow-shaped manner in the longitudinal direction of the rails, for receiving material abrasion, and in such a way that a plurality of sliding supports are lined up with one another to form arrow-shaped joints, the cross section of the joints corresponding essentially to that of the grooves. By sliding elements being designed to cover the entire rail width and to have arrow-shaped grooves, jolt-like impacts when sliding shoes strike sliding elements are markedly reduced. Moreover, by means of arrow-shaped joints, a wide transitional region is provided, in which one rail can scarcely be displaced laterally in relation to another. Jolt-like impacts on account of height differences between two rails are mitigated by the arrow-shaped transitional region. The durability of rails and sliding shoes can thereby be markedly increased.

According to the invention, furthermore, there is provision for the sliding supports to be capable of being screwed to the rails. This screw connection is appropriate, in particular, where high-grade sliding supports are concerned. Thus, if required, only the sliding support which is worn in each case is renewed.

According to the invention, furthermore, there is provision for the rails and the sliding supports to be capable in each case of being connected to one another in one piece.

According to the invention, furthermore, there is provision for the rails and the sliding supports to be capable in each case of being connected to one another in one piece as a casting. The one-piece construction, for example in the form of a casting, makes simple production, assembly and disposal possible.

According to the invention, furthermore, there is provision for the sliding supports to be capable of being made of cast steel.

Finally, the pusher furnace may be designed in such a way that the tips of the arrow-shaped grooves of the sliding supports are directed towards the direction of transport. The reception and discharge of material abrasion are thereby improved.

Figure 2:
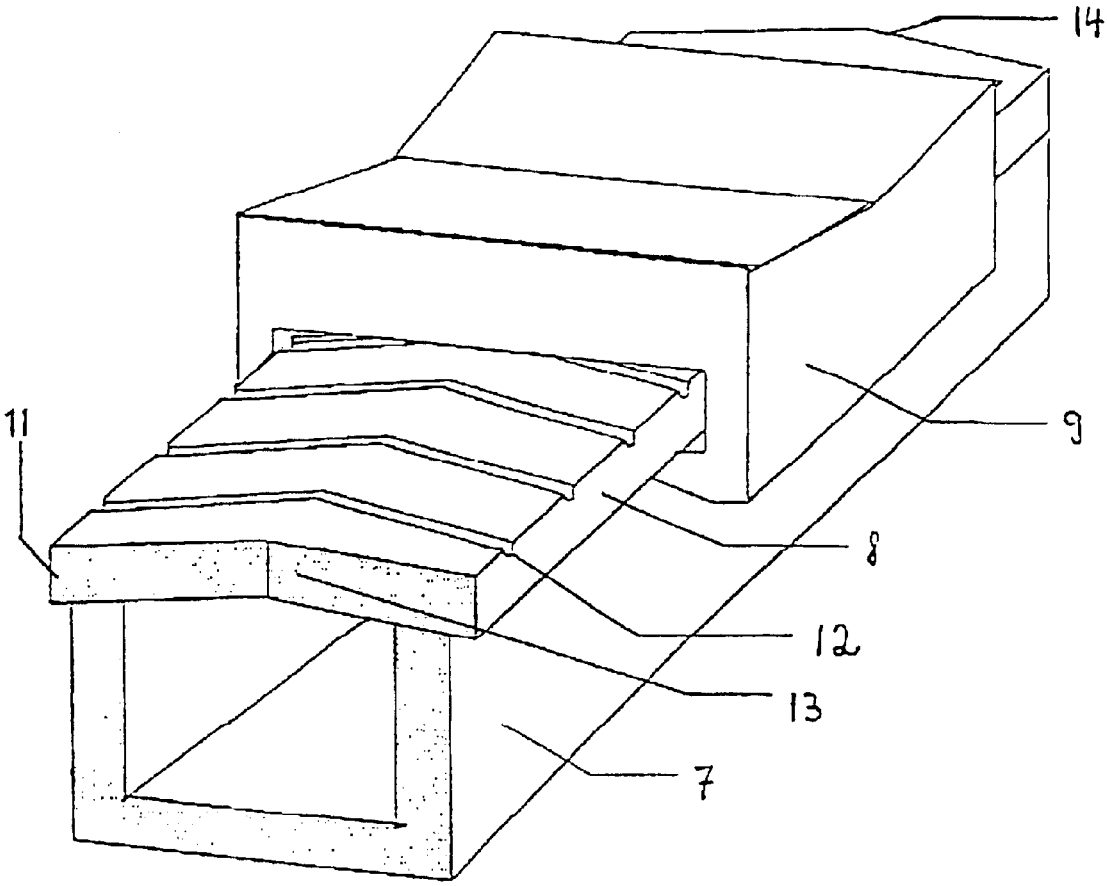

An embodiment of the pusher furnace according to the invention is described below with reference to two drawings in which:

FIG. 1 shows a pusher furnace according to the invention diagrammatically in cross section, and FIG. 2 shows a rail with a sliding shoe placed on it.

FIG. 1 shows a pusher furnace 1 with a furnace chamber, in which heating burners 2 are arranged on both sides. The pusher furnace is provided with a centrally mounted ceiling fan 3 and gas guide plates 4 for the circulation of the furnace gases. Rails 7 with sliding supports 8 are mounted on the bottom 5 of the pusher furnace 1 in two rows on legs 6 and project into the zone protected from the heating burners 2 on both sides by the gas guide plates 4. Sliding shoes 9, which carry the bar-shaped material 10 to be treated, are mounted on the rails 7 by means of the sliding supports 8 so as to be displaceable in the rail longitudinal direction.

FIG. 2 shows a U-shaped rail 7, on which is mounted a plate-shaped sliding support 8, the width of which is greater than the width of the rail 7, so as to form, on each of the two longitudinal sides of the rail 7, a projecting flange 11, under which a sliding shoe 9 sliding over the sliding support 8 engages on both sides. That region of the sliding shoe 9 which rests on the sliding support 8 is of essentially parallelepipedic design. Instead of one sliding support 8 per rail 7, a plurality of sliding supports 8 may also be mounted in a row. Moreover, a sliding support 8 of this kind may be fastened over the joint between two rails 7. Grooves 12 for the discharge of material abrasion are located on the top side of the sliding supports 8. These grooves 12 are designed to be arrow-shaped towards the direction of transport, so that a sliding shoe 9 sliding over the sliding supports 8 is not subjected to a jolt-like load when it strikes a groove edge. For the same reason, the two ends 13, 14 of the sliding support 8 are also designed in such a way that they likewise form an arrow-shaped groove with the ends of the sliding support of an identical preceding or following rail which is not illustrated here.

What is claimed is:

1. Pusher furnace with rails (7) and with sliding shoes (9) which are guided displaceably on these and carry the treatment material to be transported through the furnace, sliding supports (8) which have grooves (12) for receiving material abrasion being provided on the rails (7), characterized in that the sliding supports (8) are of plate-shaped design, in each case fully cover the rails (7) over their width and are provided on their top sides with grooves (12), running in an arrow shaped manner in the longitudinal direction of the rails (7), for receiving material abrasion, and in that a plurality of sliding supports (8) are lined up with one another to form arrow-shaped joints, the cross section of the joints corresponding essentially to that of the grooves.

2. Pusher furnace according to claim 1, characterized in that the sliding supports (8) are screwed to the rails (7).

3. Pusher furnace according to claim 1, characterized in that the rails (7) and the sliding supports (8) are in each case connected to one another in one piece.

4. Pusher furnace according to claim 3, characterized in that the rails (7) and the sliding supports (8) are in each case connected to one another in one piece as a casting.

5. Pusher furnace according to claim 1, characterized in that the sliding supports (8) are made of cast steel.

6. Pusher furnace according to claim 1, characterized in that the tips of the arrow-shaped grooves (12) are directed towards the direction of transport.

7. Pusher furnace according to claim 2, characterized in that the sliding supports (8) are made of cast steel.

8. Pusher furnace according to claim 3, characterized in that the sliding supports (8) are made of cast steel.

9. Pusher furnace according to claim 4, characterized in that the sliding supports (8) are made of cast steel.

10. Pusher furnace according to claim 2, characterized in that the tips of the arrow-shaped grooves (12) are directed towards the direction of transport.

11. Pusher furnace according to claim 3, characterized in that the tips of the arrow-shaped grooves (12) are directed towards the direction of transport.

12. Pusher furnace according to claim 4, characterized in that the tips of the arrow-shaped grooves (12) are directed towards the direction of transport.

13. Pusher furnace according to claim 5, characterized in that the tips of the arrow-shaped grooves (12) are directed towards the direction of transport.

14. Pusher furnace according to claim 7, characterized in that the tips of the arrow-shaped grooves (12) are directed towards the direction of transport.

15. Pusher furnace according to claim 8, characterized in that the tips of the arrow-shaped grooves (12) are directed towards the direction of transport.

16. Pusher furnace according to claim 9, characterized in that the tips of the arrow-shaped grooves (12) are directed towards the direction of transport.

17. A pusher furnace comprising rails (7), sliding shoes (9) which are guided displaceably on said rails to carry the treatment material to be transported through the furnace, sliding supports (8) provided on said rails, said sliding supports having a plate shaped design and having grooves (12) on their top sides for receiving material abraded from the treatment material, wherein said sliding supports (8) fully cover the rails (7) over their width, wherein the grooves that are provided on the top sides of said sliding supports (8) extend in an arrow shaped manner in the longitudinal direction of the rails (7), wherein said sliding supports (8) are lined up with one another to form arrow-shaped joints, and wherein the cross section of the sliding support joints correspond essentially to the arrow shape of the sliding support grooves.

18. The pusher furnace claimed in claim 17 wherein the grooves that are provided on the top sides of said sliding supports (8) have tips that are directed towards the direction of transport within the furnace.

19. The pusher furnace claimed in claim 17 wherein said rails (7) and said sliding supports (8) are, in each case, connected to one another in one piece as a casting.

20. The pusher furnace claimed in claim 18 wherein said rails (7) and said sliding supports (8) are, in each case, connected to one another in one piece as a casting.

* * * * *